US010310526B2

(12) United States Patent
Malinowski et al.

(10) Patent No.: US 10,310,526 B2
(45) Date of Patent: Jun. 4, 2019

(54) QUIESCENT CURRENT LIMITATION FOR A LOW-DROPOUT REGULATOR IN DROPOUT CONDITION

(71) Applicant: Dialog Semiconductor (UK) Limited, London (GB)

(72) Inventors: Slawomir Malinowski, Graz (AT); Robert Goslawski, Graz (AT)

(73) Assignee: Dialog Semiconductor (UK) Limited, London (GB)

( * ) Notice: Subject to any disclaimer, the term of this patent is extended or adjusted under 35 U.S.C. 154(b) by 292 days.

(21) Appl. No.: 14/864,987

(22) Filed: Sep. 25, 2015

(65) Prior Publication Data

US 2016/0282890 A1 Sep. 29, 2016

(30) Foreign Application Priority Data

Mar. 24, 2015 (DE) ..... 10 2015 205 359

(51) Int. Cl.

| | |
|---|---|
| ***G05F 1/575*** | (2006.01) |
| *G05F 1/565* | (2006.01) |
| *G05F 1/573* | (2006.01) |

(52) U.S. Cl.

CPC ..... *G05F 1/575* (2013.01); *G05F 1/565* (2013.01); *G05F 1/573* (2013.01)

(58) Field of Classification Search

CPC ..... G05F 1/565; G05F 1/575; G05F 1/573

See application file for complete search history.

(56) References Cited

U.S. PATENT DOCUMENTS

| | | | | |
|---|---|---|---|---|
| 5,867,015 A * | 2/1999 | Corsi | G05F 3/242 | 323/316 |
| 6,801,419 B2 * | 10/2004 | Fukui | G05F 1/573 | 361/93.1 |
| 7,382,305 B1 * | 6/2008 | Murden | G05F 1/575 | 327/539 |
| 7,615,977 B2 * | 11/2009 | Gicquel | G05F 3/262 | 323/273 |

(Continued)

OTHER PUBLICATIONS

German Office Action 10 2015 205 359.8 and English translation, dated Jul. 22, 2015, Dialog Semiconductor (UK) Limited.

*Primary Examiner* — Fred E Finch, III
*Assistant Examiner* — Rafael O. De León Domenech
(74) *Attorney, Agent, or Firm* — Salie Ackerman LLC; Stephen B. Ackerman

(57) ABSTRACT

An low dropout regulator and method that has reduced quiescent current consumption is presented. The voltage regulator circuit comprises an output terminal, a first circuit branch connected between an input voltage level and the output terminal, a second circuit branch connected between the input voltage level and a predetermined voltage level, a first current mirror for mirroring a current flowing in the second circuit branch to the first circuit branch, a first feedback circuit to regulate the output voltage, and a second feedback circuit for controlling the second switching element. The second feedback circuit comprises a current sensing means for sensing a current that depends on a current flowing in the first circuit branch and to control the second switching element such that the current flowing through the second circuit branch is limited to a current that depends on the current sensed by the current sensing means.

27 Claims, 5 Drawing Sheets

(56) References Cited

U.S. PATENT DOCUMENTS

| | | | | |
|---|---|---|---|---|
| 2005/0134242 | A1* | 6/2005 | Gradinariu | G05F 1/575 323/282 |
| 2006/0208770 | A1 | 9/2006 | Perez et al. | |
| 2007/0057660 | A1* | 3/2007 | Lin | G05F 1/575 323/316 |
| 2008/0265852 | A1* | 10/2008 | Imura | G05F 1/575 323/277 |
| 2012/0262137 | A1 | 10/2012 | Arigliano et al. | |
| 2013/0147448 | A1* | 6/2013 | Kadanka | G05F 1/565 323/280 |
| 2013/0285631 | A1* | 10/2013 | Bisson | G05F 1/575 323/280 |
| 2015/0015331 | A1 | 1/2015 | Kronmueller | |

* cited by examiner

QUIESCENT CURRENT LIMITATION FOR A LOW-DROPOUT REGULATOR IN DROPOUT CONDITION

TECHNICAL FIELD

This application relates to voltage regulator circuits and to methods of operating voltage regulator circuits. The application particularly relates to low-dropout regulator circuits and methods of operating low-dropout regulator circuits.

BACKGROUND

Low-dropout regulators (LDOs) are known in the art. FIG. 1 schematically illustrates such conventional LDO. Broadly speaking, the LDO of FIG. 1 consists of an error amplifier input stage, a common source second stage, which converts the error signal into a current, and a current mirror to amplify said current in a predetermined ratio to be supplied to the output load. In more detail, the LDO comprises an input terminal 10 to which an input voltage is applied, and output terminal 20 at which a regulated output voltage is output, an error amplifier 40 receiving a reference voltage and a predetermined fraction of the output voltage at its input terminals, a switching element 45 that is controlled by the error amplifier 40, and a current mirror 30, 35 for mirroring a current flowing through the switching element 45 to the output terminal side to be supplied to a load connected to the output terminal 20.

A threshold voltage for the input voltage above which the output voltage is regulated by the LDO depends on the predetermined fraction of the output voltage that is applied to the error amplifier 40, and on the reference voltage. For input voltages below the threshold voltage, the LDO is in the dropout mode (dropout condition) and the output voltage is not regulated. In this case, the switching element 45 is fully open, and the current I_diode flowing through the switching element 45 is only limited by the on-state resistance of the switching element 45 and the diode voltage drop of the transistor 30 on the input side of the current mirror (i.e. the transistor of the current mirror conducting the input current). Accordingly, the quiescent current of the conventional LDO described above is comparably large, resulting in undesirably large current consumption of the LDO, even for small load currents.

SUMMARY

There is a need for an improved LDO that has reduced quiescent current consumption, and for an improved method of operating (controlling) an LDO that reduces quiescent current consumption of the LDO. In other words, there is a need for a LDO that is more power efficient. In view of this need, the present document proposes a voltage regulator circuit and a method of operating (controlling) a voltage regulator circuit having the features of the respective independent claims.

An aspect of the disclosure relates to a voltage regulator circuit for regulating an output voltage in dependence on an input voltage. The voltage regulator circuit may be a LDO. The voltage regulator circuit may comprise an output terminal for outputting the output voltage. The voltage regulator circuit may further comprise a first circuit branch connected between an input voltage level and the output terminal. The voltage regulator circuit may further comprise a second circuit branch connected between the input voltage level and a predetermined voltage level. The predetermined voltage level may correspond to the ground voltage level (i.e. ground). The second circuit branch may comprise a first switching element and a second switching element connected in series. The voltage regulator circuit may further comprise a first current mirror for mirroring a current flowing in the second circuit branch to the first circuit branch. A first mirror ratio of the current flowing in the first circuit branch to the current flowing in the second circuit branch may be a predetermined mirror ratio (i.e. the current flowing in the first circuit branch may be given by the predetermined mirror ratio times the current flowing in the second circuit branch). Said predetermined mirror ratio may be greater than 1. The voltage regulator circuit may further comprise a first feedback circuit (first feedback loop) for regulating the output voltage by controlling (driving) the first switching element in dependence on the output voltage. Controlling the first switching element may be performed further based on a predetermined reference voltage. The voltage regulator circuit may yet further comprise a second feedback circuit (second feedback loop) for controlling (driving) the second switching element. The second feedback circuit may comprise a current sensing means for sensing a current that depends on a current flowing in the first circuit branch (e.g. an actual load current). The current sensed by the current sensing means may be in a predetermined ratio to the current flowing in the first circuit branch (i.e. the sensed current may be given by the predetermined ratio times the current flowing in the first circuit branch). Said predetermined ratio may be smaller than 1. Said predetermined ratio may be the inverse of said predetermined mirror ratio (first mirror ratio) of the first current mirror. The second feedback circuit may be configured to control the second switching element such that the current flowing through the second circuit branch is limited to a current that depends on the current sensed by the current sensing means.

Configured as above, the voltage regulator circuit regulates the output voltage by control of the first switching element during operation in regulation mode. In dropout mode, i.e. when the input voltage is below a given threshold voltage for the input voltage, the current flowing in the second circuit branch is limited by means of the second switching element in dependence on the sensed current. Thereby, the current flowing in the second circuit branch in dropout mode (i.e. the quiescent current) can be limited to an amount of current that is necessary for supplying a desired load current to an electric load connected to the output terminal. Accordingly, operation of the voltage regulator circuit in regulation mode is not affected, and the quiescent current is limited compared to conventional voltage regulator circuits. For small load currents, also the quiescent current is very low. This results in an improvement of power efficiency of the voltage regulator circuit compared to conventional voltage regulator circuits.

In embodiments, the first circuit branch may comprise an output pass device connected between the input voltage level and the output terminal. The output pass device may be embodied by a first transistor (e.g. a FET, in particular a MOSFET, such as a PMOS or an NMOS, for example) connected between the input voltage level and the output terminal. The second circuit branch may comprise a second transistor (e.g. a FET, in particular a MOSFET, such as a PMOS or an NMOS, for example), a third transistor (e.g. a FET, in particular a MOSFET, such as a PMOS or an NMOS, for example), and a fourth transistor (e.g. a FET, in particular a MOSFET, such as a PMOS or an NMOS, for example) connected in series. The second to fourth transistors may be connected between the input voltage level and the predetermined voltage level in the order of the second transistor, the third transistor, and the fourth transistor. The first transistor and the second transistor may form the first current mirror. The gate and drain terminals of the second transistor may be connected to each other (shorted). The third transistor may act as the first switching element. The fourth transistor may act as the second switching element. The current sensing means may be configured to sense a current that depends on a current flowing through the first transistor. The second feedback circuit may be configured to control the second switching element (e.g. the fourth transistor) such that the current flowing through the second switching element is limited to a current that is in a predetermined first ratio to the current sensed by the current sensing means (i.e. the limiting current may be given by the predetermined first ratio times the sensed current). The predetermined first ratio may be equal to or greater than 1. The predetermined first ratio may be smaller than the predetermined mirror ratio of the first current mirror.

By the above configuration, the voltage regulator circuit can be implemented in a simple manner, using only readily available standard components.

In embodiments, the current sensing means may be configured such that the current sensed by the current sensing means is in a predetermined second ratio to the current flowing through the output pass device (e.g. the first transistor), i.e. the sensed current may be given by the predetermined second ratio times the current flowing through the output pass device. The predetermined second ratio may be smaller than 1. The predetermined second ratio may be substantially equal to the inverse of the predetermined mirror ratio of the first current mirror. The inverse of the predetermined second ratio may be larger than the predetermined first ratio, i.e. a product of the predetermined second ratio and the predetermined first ratio may be smaller than 1.

In embodiments, the second feedback circuit may be configured to control the second switching element (e.g. the fourth transistor) in dependence on the output voltage and a voltage at an output terminal of the current sensing means. The voltage at the output terminal of the current sensing means may depend on (e.g. may be proportional to) the current flowing in the output pass device (i.e. in the first circuit branch).

By appropriate choice of the above predetermined ratios and proportionality factors, the quiescent current may be limited to a value that avoids excessive current consumption, but on the other hand does not impede regulation of the output voltage during operation in regulation mode.

In embodiments, the second feedback circuit may comprise a third circuit branch connected between the input voltage level and the predetermined voltage level. The third circuit branch may comprise a fifth transistor and a sixth transistor connected in series. The fifth transistor may act as the current sensing means. The fifth transistor and the first transistor may be configured to form a second current mirror for mirroring the current flowing through the first transistor to the fifth transistor. In other words, the fifth transistor and the first transistor may be connected such that a current flowing through the fifth transistor is in a predetermined mirror ratio of the second current mirror (second mirror ratio) to the current flowing through the first transistor. The predetermined mirror ratio of the second current mirror may be the predetermined second ratio. The fourth transistor and the sixth transistor may be configured to form a third current mirror for mirroring the current flowing through the sixth transistor to the fourth transistor. In other words, the fourth transistor and the sixth transistor may be connected such that a current flowing through the fourth transistor is in a predetermined third ratio (third mirror ratio) to the current flowing through the sixth transistor. The predetermined third ratio may be equal to the predetermined first ratio. The second feedback circuit may be configured to control the sixth transistor in dependence on the output voltage and a voltage at an output terminal of the fifth transistor acting as the current sensing means (e.g. a voltage at an intermediate node between the fifth transistor and the sixth transistor). Said voltage may depend on (e.g. be proportional to) the current flowing in the output pass device (i.e. in the first circuit branch). Due to the fourth and sixth transistors forming the third current mirror, the second feedback circuit may be further configured to control the fourth transistor in dependence on the output voltage and said voltage at the intermediate node between the fifth transistor and the sixth transistor. The second feedback circuit may be said to be configured to perform said control based on the output voltage and a voltage drop across the current sensing means.

In embodiments, the second feedback circuit may be configured to output a drive voltage for driving the sixth transistor in dependence on the output voltage and the voltage at said intermediate node. The second feedback circuit may be further configured to drive the sixth transistor, by applying the drive voltage to a control terminal of the sixth transistor, such that the current flowing through the fourth transistor increases if the output voltage decreases, and to drive the sixth transistor such that the current flowing through the fourth transistor decreases if the output voltage increases. The second feedback circuit may further apply the drive voltage to a control terminal of the fourth transistor (second switching element).

In embodiments, the voltage regulator circuit may further comprise a first error amplifier receiving a voltage depending on the output voltage and a voltage depending on the voltage at said intermediate node at its positive and negative input terminals. An output terminal of the first error amplifier may be connected to the control terminal of the sixth transistor. Said output terminal may be further connected to a control terminal of the fourth transistor (second switching element). The second error amplifier may be included in the first feedback circuit.

In embodiments, the voltage regulator circuit may further comprise a current conveyor circuit receiving a voltage depending on the output voltage and a voltage depending on the voltage at said intermediate node at its input terminals. Said voltage at said intermediate node may be the voltage at the output of the current sensing means. The current conveyor circuit may act as (replace) the first error amplifier. An output terminal of the current conveyor circuit may be connected to the control terminal of the sixth transistor. Said output terminal may be further connected to the control terminal of the second switching element (e.g. the fourth transistor). The current conveyor circuit may be configured to equalize a voltage at its first input terminal to whatever voltage is applied to its second input terminal. The voltage depending on the output voltage may be applied to the second input terminal of the current conveyor circuit.

In embodiments, the current conveyor circuit may comprise a fourth circuit branch connected between the output terminal and the predetermined voltage level. The current conveyor circuit may further comprise a fifth circuit branch connected between said intermediate node (i.e. the output terminal of the current sensing means) and the predetermined voltage level. The fourth current branch may comprise a seventh transistor and a first current sink connected in series.

The fifth current branch may comprise an eighth transistor and a second current sink connected in series. Control terminals of the seventh and eighth transistors may be connected to each other. A gate terminal and a drain terminal of the seventh transistor may be connected to each other (shorted). The output terminal of the current conveyor circuit may be arranged between the eighth transistor and the second current sink. The first and second current sinks may be arranged towards the predetermined voltage level (e.g. ground). Further, the first and second current sinks may be configured to pull respective currents from the seventh transistor and the eighth transistor.

In embodiments, the voltage regulator circuit may further comprise a current conveyor circuit receiving a voltage depending on the output voltage and a voltage depending on the voltage at said intermediate node at its input terminals. The current conveyor circuit may comprise a fourth circuit branch connected between the output terminal and the predetermined voltage level. The current conveyor circuit may further comprise a fifth circuit branch connected between said intermediate node (i.e. the output terminal of the current sensing means) and the predetermined voltage level. The fourth circuit branch may comprise a seventh transistor and a first current sink connected in series. The fifth circuit branch may comprise an eighth transistor and a second current sink connected in series. Control terminals of the seventh and eighth transistors may be connected to each other. Further, said control terminals may be connected to a drain terminal of the eighth transistor. The voltage regulator circuit may further comprise a ninth transistor arranged in the third circuit branch. An output terminal of the current conveyor circuit may be connected to a control terminal of the ninth transistor. For example, the control terminal of the ninth transistor may be connected to a node between the seventh transistor and the first current sink. The first and second current sinks may be arranged towards the predetermined voltage level (e.g. ground). Further, the first and second current sinks may be configured to pull respective currents from the seventh transistor and the eighth transistor. A gate terminal and a drain terminal of the sixth transistor may be connected to each other (shorted).

By providing a current conveyor circuit, the second feedback circuit may be implemented in a simple and reliable manner.

In embodiments, the voltage regulator circuit may further comprise a second error amplifier for controlling the first switching element (e.g. the third transistor). The second error amplifier may receive a reference voltage and a voltage depending on the output voltage (e.g. a voltage that is a predetermined fraction of the output voltage) at its positive and negative input terminals. An output terminal of the second error amplifier may be connected to a control terminal of the first switching element. The reference voltage may be supplied to the positive (i.e. non-inverting) input terminal of the second error amplifier, and the voltage depending on the output voltage may be supplied to the negative (i.e. inverting) input terminal of the second error amplifier. The second error amplifier may be included in the first feedback circuit. The voltage depending on the output voltage may be proportional to the output voltage, e.g. may be a fraction of the output voltage. To this end, the output voltage may be applied to a voltage divider, e.g. a serial connection of resistors connected between the output voltage and the predetermined voltage level.

Configured as above, the voltage regulator circuit is capable of accurately regulating the output voltage to a target value that depends on the proportionality factor between the voltage depending on the output voltage and the output voltage itself, and on the reference voltage.

Another aspect of the disclosure relates to a method of operating a voltage regulator circuit for outputting a regulated output voltage. The voltage regulator circuit may comprise an output terminal for outputting the output voltage. The voltage regulator circuit may further comprise a first circuit branch connected between an input voltage level and the output terminal. The voltage regulator circuit may further comprise a second circuit branch connected between the input voltage level and a predetermined voltage level. The predetermined voltage level may correspond to the ground voltage level (i.e. ground). The second circuit branch may comprise a first switching element and a second switching element connected in series. The method may comprise mirroring a current flowing in the second circuit branch to the first circuit branch. A first mirror ratio (first mirror ratio) of the current flowing in the first circuit branch to the current flowing in the second circuit branch may be a predetermined mirror ratio (i.e. the current flowing in the first circuit branch may be given by the predetermined mirror ratio times the current flowing in the second circuit branch). Said predetermined mirror ratio may be greater than 1. The method may further comprise regulating the output voltage by controlling the first switching element in dependence on the output voltage. Controlling the first switching element may be performed further based on a predetermined reference voltage. The method may further comprise sensing a current that depends on a current flowing through the first circuit branch (e.g. an actual load current). The current sensed by the current sensing means may be in a predetermined ratio to the current flowing in the first circuit branch (i.e. the sensed current may be given by the predetermined ratio times the current flowing in the first circuit branch). Said predetermined ratio may be smaller than 1. Said predetermined ratio may be the inverse of said predetermined mirror ratio of the first current mirror. The method may yet further comprise controlling the second switching element such that the current flowing through the second circuit branch is limited to a current that depends on the sensed current.

In embodiments, the first circuit branch may comprise an output pass device connected between the input voltage level and the output terminal. The output pass device may be embodied by a first transistor (e.g. a FET, in particular a MOSFET, such as a PMOS or an NMOS, for example) connected between the input voltage level and the output terminal. Sensing said current may be performed such that the sensed current depends on the current flowing through the first transistor. Controlling the second switching element may be performed such that the current flowing through the second switching element is limited to a current that is in a predetermined first ratio to the sensed current (i.e. the limiting current may be given by the predetermined first ratio times the sensed current). The predetermined first ratio may be equal to or greater than 1. The predetermined first ratio may be smaller than the predetermined first mirror ratio.

In embodiments, the voltage regulator circuit may comprise a second transistor (e.g. a FET, in particular a MOSFET, such as a PMOS or an NMOS, for example) that forms a current mirror with the output pass device (e.g. the first transistor) and that acts as a current sensing means for sensing said current. The second transistor may correspond to the fifth transistor described in the above aspect. Thereby, the current flowing in the output pass device may be mirrored to the current sensing means in a predetermined second mirror ratio, i.e. the sensed current may be given by the predetermined second mirror ratio times the current flowing in the output pass device. Said predetermined second mirror ratio may be smaller than 1. Further, said predetermined second mirror ratio may be substantially the inverse of the first mirror ratio. Then, controlling the second switching element may be performed in dependence on the output voltage and a voltage at an output terminal of the current sensing means (e.g. the second transistor). The voltage at the output terminal of the current sensing means may depend on (e.g. be proportional to) the current flowing in the output pass device (i.e. in the first circuit branch).

In embodiments, the voltage regulator circuit may further comprise a third circuit branch connected between the input voltage level and the predetermined voltage level. The third circuit branch may comprise the second transistor and a third transistor (e.g. a FET, in particular a MOSFET, such as a PMOS or an NMOS, for example) connected in series. The third transistor may correspond to the sixth transistor described in the above aspect. The method may further comprise mirroring a current flowing in the third circuit branch to the second circuit branch. A predetermined third mirror ratio for said mirroring may be equal to or greater than 1. The method may further comprise controlling the third transistor in dependence on the output voltage and a voltage at an intermediate node between the second transistor and the third transistor.

In embodiments, the method may further comprise generating a drive voltage for driving the third transistor in dependence on the output voltage and the voltage at said intermediate node. Generating the drive voltage may be performed in such a manner that the current flowing through the second switching element increases if the output voltage decreases, and that the current flowing through the second switching element decreases if the output voltage increases.

It will be appreciated that method steps and apparatus features may be interchanged in many ways. In particular, the details of the disclosed apparatus can be implemented as a method, as the skilled person will appreciate.

BRIEF DESCRIPTION OF THE DRAWINGS

Embodiments of the disclosure are explained below in an exemplary manner with reference to the accompanying drawings, wherein FIG. 1 schematically illustrates a voltage regulator circuit to which examples of the disclosure may be applied, FIG. 2 schematically illustrates an example of a voltage regulator circuit according to embodiments of the disclosure, FIG. 3 schematically illustrates another example of a voltage regulator circuit according to embodiments of the disclosure, FIG. 4 schematically illustrates another example of a voltage regulator circuit according to embodiments of the disclosure.

DESCRIPTION

Figure 2:
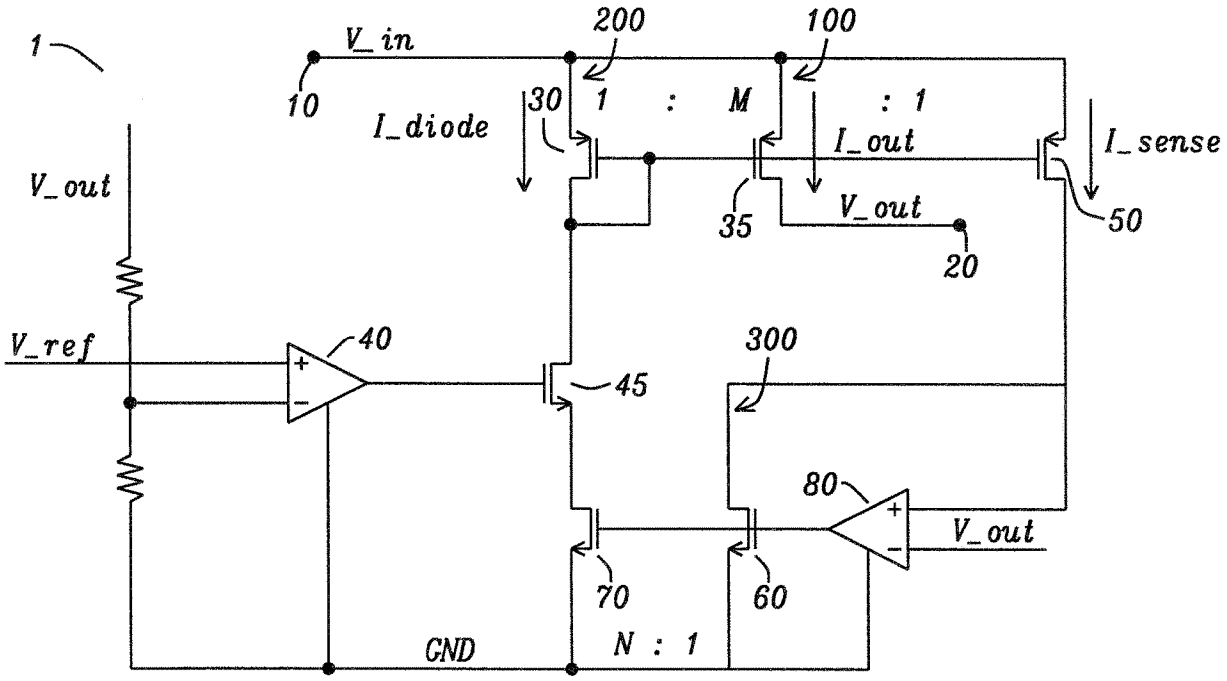

FIG. 2 schematically illustrates an example of a voltage regulator circuit 1 according to embodiments of the disclosure. The voltage regulator circuit 1 may comprise an input terminal 10 for receiving an input voltage V_in, and an output terminal 20 for outputting a regulated output voltage V_out. The output terminal 20 may be connected to the input voltage level (i.e. to the voltage level of the input terminal 10) via a first circuit branch 100. Said first circuit branch 100 may comprise an output pass device, e.g. a first transistor 35. The voltage regulator circuit 1 may further comprise a second circuit branch 200 connected between the input voltage level and a predetermined voltage level (e.g. ground). The second circuit branch 200 may comprise second to fourth transistors 30, 45, 70 connected in series, of which the third transistor 45 exemplarily embodies a first switching element, and the fourth transistor 70 exemplarily embodies a second switching element. Therein, switching elements are understood to be not limited to actual switches that can attain an on state (open state) and an off state (closed state), but to also relate to elements that can attain intermediate (conducting) states between these two states. One non-limiting example of a switching element in the context of the present disclosure is a transistor.

The first and second transistors 35, 30 may form a first current mirror configured to mirror a current flowing in the second transistor 30 (i.e. in the second circuit branch 200) to the first transistor 35 (i.e. to the first circuit branch 100). To this end, the control terminals (e.g. gate terminals) of the first and second transistors 35, 30 may be connected to each other. Further, a drain terminal of the second transistor 30 may be connected to the control terminal of the second transistor 30. A first mirror ratio R1 of the first current mirror may be given by M (i.e. M:1). Accordingly, the current flowing in the first transistor 35, I_out, may be given by the first mirror ratio R1 times the current flowing in the second transistor 30, (I_diode. That is, I_out=M·I_diode. M may be chosen to be greater than 1.

The voltage regulator circuit 1 may further comprise a first feedback circuit for controlling (driving) the first switching element. The first feedback circuit may control the first switching element in dependence on the output voltage. The first feedback circuit may control the first switching element further in dependence on a reference voltage V_ref for the regulated output voltage. The first feedback circuit may comprise an error amplifier 40 (second error amplifier in the claims) for generating a control voltage (drive voltage) for the third transistor 45 that is applied to a control terminal of the third transistor 45. The error amplifier 40 of the first feedback circuit may receive a voltage depending on the output voltage and the reference voltage at its input terminals. The voltage depending on the output voltage may be a predetermined fraction of the output voltage. Said predetermined fraction may be obtained by a voltage divider comprising two or more resistors connected between the output voltage and the predetermined voltage level. The reference voltage may be supplied to the positive (i.e. non-inverting) input terminal of the error amplifier 40 of the first feedback circuit, and the voltage depending on the output voltage may be supplied to the negative (i.e. inverting) input terminal.

Configured as above, the third transistor 45 may be biased to be in the (fully) open state for the input voltage being below a given threshold voltage. In this case, the output voltage is not regulated and is substantially equal to the input voltage (minus a potential voltage drop at the output pass device). This condition is referred to as the dropout condition. The threshold voltage is given by a function of the reference voltage and the fraction of the output voltage that is supplied to the error amplifier 40 of the first feedback circuit. Once the input voltage rises above the threshold voltage, the error amplifier 40 may drive the third transistor 45 in the linear region in dependence on the output voltage and thereby control the current I_diode flowing in the second circuit branch 200. By virtue of the first current mirror mirroring the current in the second circuit branch 200 to the first circuit branch 100, the output voltage may be regulated by controlling the current flowing in the second circuit branch 200.

An example for control of the first switching element by the first feedback circuit for the voltage regulator circuit 1 in the regulation mode will be described next. Assume that the output voltage V_out drops by some amount, e.g. due to a change in the load that is applied to the output terminal 20. Then, the output voltage of the error amplifier 40 becomes more positive and the first switching element is controlled to have a smaller resistance (i.e. to be more open). Since the first switching element is more open, the current in the second circuit branch 200 increases, and by operation of the first current mirror also the current flowing in the first circuit branch 100 increases, i.e. the output current I_out increases. Consequently, the output voltage V_out increases. For initially increasing output voltage V_out, the above-described changes of quantities would be reversed.

The voltage regulator circuit 1 may further comprise a second feedback circuit for controlling (driving) the second switching element (e.g. the fourth transistor 70). The second feedback circuit may comprise a current sensing means for sensing a current I_sense depending on the current flowing in the first circuit branch 100, I_out. The sensed current I_sense may be proportional to the current flowing through the first circuit branch 100, I_out. For instance, the sensed current may be in a predetermined ratio (predetermined second ratio in the claims) to the current flowing in the first circuit branch 100. The second feedback circuit may be configured to control the second switching element such that a current flowing through the second switching element is limited to a current (limiting current I_limit) that depends on the sensed current, e.g. is proportional to the sensed current. The second feedback circuit may control the second switching element in dependence on the output voltage and a voltage at an output terminal of the current sensing means. Said voltage at the output terminal of the current sensing means may be proportional to the current flowing in the first circuit branch 100.

The second feedback circuit may comprise a third circuit branch 300 comprising a fifth transistor 50 that exemplarily embodies the current sensing means. The fifth transistor 50 and the first transistor 35 may form a second current mirror for mirroring the current flowing in the first transistor 35 (i.e. in the first circuit branch 100) to the fifth transistor 50 (i.e. to the third circuit branch 300). To this end, the control terminals (e.g. gate terminals) of the first and fifth transistors 35, 50 may be connected to each other. The second current mirror may have a second mirror ratio R2. Accordingly, the current flowing in the fifth transistor 50, I_out, may be given by the second mirror ratio R2 times the current flowing in the first transistor 35, I_out. The second mirror ratio R2 of the second current mirror may be smaller than 1. For instance, said second mirror ratio may be given by 1/M (i.e. 1:M). In this case, I_sense=1/M·I_out, so that the sensed current I_sense is substantially equal to the current flowing in the second circuit branch 200, I_diode.

The third circuit branch 300 may further comprise a sixth transistor 60 connected in series with the fifth transistor 50. Accordingly, the sixth transistor 60 may conduct the same current as the fifth transistor 50, i.e. the sensed current I_sense. The sixth transistor 60 may be arranged closer towards the predetermined voltage level than the fifth transistor 50. The sixth transistor 60 may form a third current mirror with the fourth transistor 70 (exemplarily embodying the second switching element) for mirroring a current flowing through the sixth transistor 60 (i.e. in the third circuit branch 300) to the fourth transistor 70 (i.e. to the second circuit branch 200). The third current mirror may have a third mirror ratio R3, such that the current potentially flowing through the fourth transistor 70 (limiting current I_limit) is given by the third mirror ratio R3 times the current flowing through the sixth transistor 60, I_sense. Notably, depending on the pass resistance of the third transistor 45, the current flowing in the second circuit branch 200 may be smaller than said limiting current. Accordingly, the current flowing in the second circuit branch 200 may be said to be limited to a current that depends on the sensed current, e.g. is in a predetermined first ratio to the sensed current. The predetermined first ratio may be given by the third mirror ratio R3 of the third current mirror. The third mirror ratio may be given by N which is equal to or greater than 1. Further, said N may be smaller than M defined above. The reason for choosing N larger than 1 is to allow for some margin in the control of the regulated output voltage, i.e. to avoid a case in which the current flowing through the second circuit branch 200 is limited to a current that is too small to provide for sufficient load current I_out.

The second feedback circuit may further comprise an error amplifier 80 (first error amplifier in the claims). the error amplifier 80 may control the sixth transistor 60 (and accordingly also the fourth transistor 70) by applying a drive voltage to a control terminal of the sixth transistor 60. The error amplifier 80 may control the sixth transistor 60 depending on the output voltage and a voltage at an output terminal of the current sensing means. The voltage at the output terminal of the current sensing means may be a voltage at an intermediate node between the fifth transistor 50 and the sixth transistor 60, e.g. a voltage at a drain terminal of the fifth transistor 50. The error amplifier 80 may receive the output voltage and the voltage at the output terminal of the current sensing means at its input terminals, e.g. the voltage at the output terminal of the current sensing means at its positive (i.e. non-inverting) input terminal, and the output voltage at its negative (i.e. inverting) input terminal.

An example for control of the second switching element by the second feedback circuit for the voltage regulator circuit 1 being in the regulation mode will be described next. Assume that the output voltage V_out drops by some amount, e.g. due to a change in the load that is applied to the output terminal 20. Then, the output voltage of the error amplifier 80 of the second feedback circuit becomes more positive, and the fourth and sixth transistors 70, 60 are controlled to have a smaller resistance (i.e. to be more open). Accordingly, the voltage at the output terminal of the current sensing means also drops, that is, the second feedback circuit acts as a voltage equalizer for its input voltages. Further, since the fourth transistor 70 is more open, the current in the second circuit branch 200 may increase under control of the first feedback circuit, as described above (that is, the limiting current increases), and by operation of the first current mirror also the current flowing in the first circuit branch 100, i.e. the output current I_out increases. Consequently, the output voltage V_out increases. For initially increasing output voltage V_out, the above-described changes of quantities would be reversed.

On the other hand, when the voltage regulator circuit 1 is in dropout mode, the second switching element is turned fully on, as described above. However, the current flowing in the second circuit branch 200 is limited by the resistance of the second switching element (e.g. the fourth transistor 70), which may hence be said to act as a limiter for the current flowing through the second circuit branch. In other words, limitation of the current I_diode flowing through the second circuit branch 200 is realized by other devices connected in series in the second circuit branch 200, in the present case the second switching element (e.g. the fourth transistor 70). The second feedback circuit comprising the current sensing means (e.g. the fifth transistor 50), the sixth transistor, and the error amplifier 80 works as a Vds equalizer and allows for a current measurement in the current sensing means, wherein the sensed current I_sense is proportional to the output current I_out. The proportionality is defined by the second mirror ratio (e.g. 1:M). The sensed current also flows through the sixth transistor 60 and is mirrored to the second switching element with mirror ratio N. In an ideal case, N would be set to one; setting N larger than 1 guarantees for some margin for process mismatch and offsets in the regulation of the output voltage V_out. In this configuration, the limiting current is proportional to the output current (load current) I_out, that is, the limiting current may be set to a value that is sufficient for allowing output of a desired load current. The limiting current depends on the output current (load current) I_out, the second mirror ratio, and the third mirror ratio. Disregarding voltage losses, the limiting current I_limit may be given by I_limit=N/M·I_out<I_out. That is, by appropriate choice of the second and third mirror ratios, the limiting current may be set to a value that prevents an excessive quiescent current, but at the same time allows for output of a desired load current.

A method of operating the voltage regulator circuit 1 may comprise a step of mirroring a current flowing in the second circuit branch 200 to the first circuit branch 100. This step may be performed by the first current mirror. A step of controlling the first switching element in dependence on the output voltage to regulate said output voltage may be performed e.g. by the first feedback circuit. A step of sensing a current that depends on a current flowing through the output pass device may be performed e.g. by the current sensing means. A step of controlling the second switching element such that the current flowing through the second circuit branch 200 is limited to a current that depends on the sensed current may be performed e.g. by the second feedback circuit. Said last step may comprise mirroring the current flowing in the third circuit 300 branch to the second circuit branch 200 and controlling the sixth transistor 60 in dependence on the output voltage and the voltage at the output terminal of the current sensing means.

Figure 3:
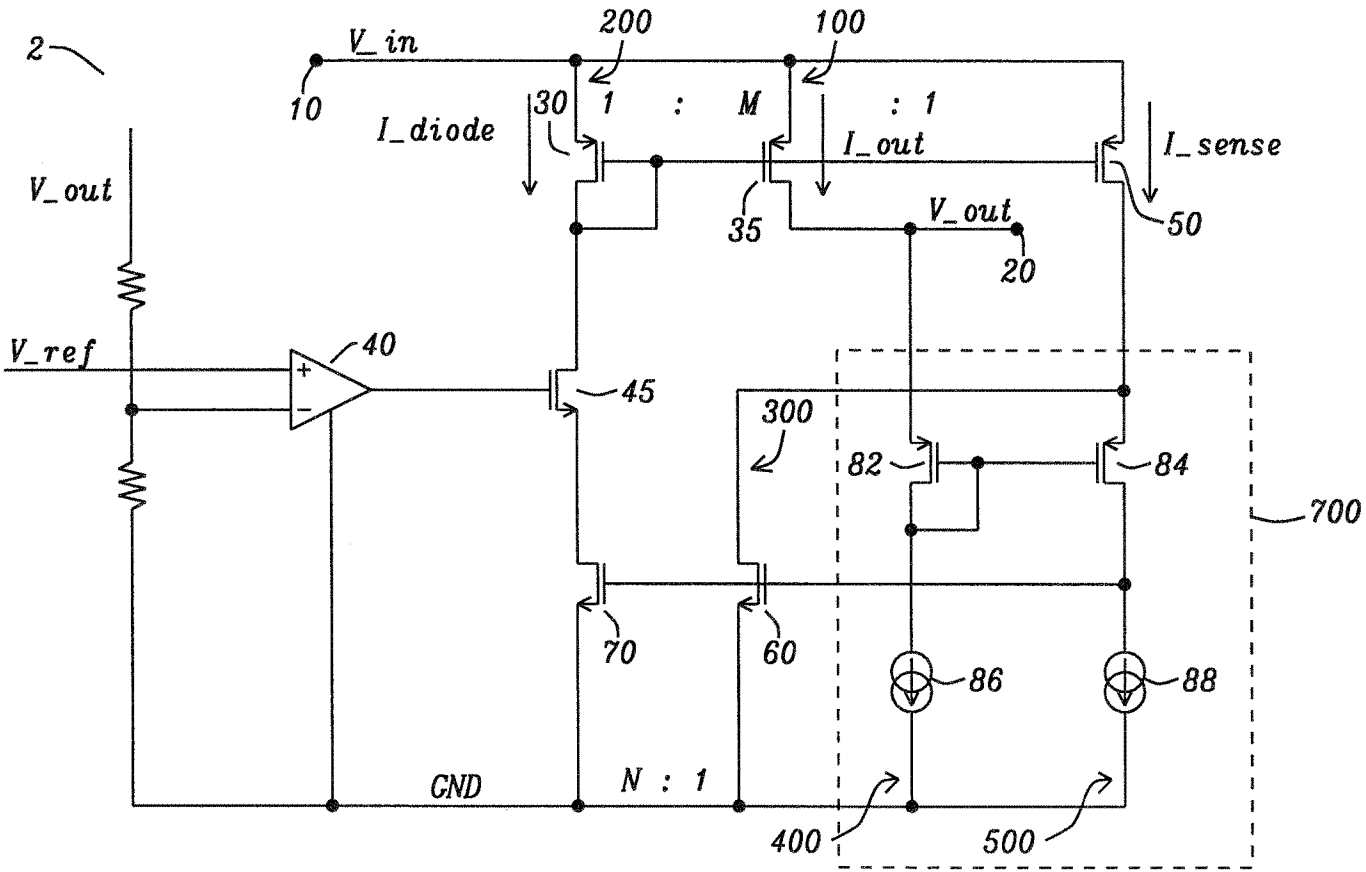

FIG. 3 schematically illustrates an exemplary implementation of the voltage regulator circuit 1 of FIG. 2. The voltage regulator circuit 2 (i.e. the second feedback circuit) may comprise, instead of the first error amplifier 80, a current conveyor (voltage mirror) 700. The current conveyor 700 may be a very fast current conveyor. The current conveyor 700 may receive the output voltage and the voltage at the output terminal of the current sensing means at its input terminals. The current conveyor 700 may be configured to equalize a voltage at its first input terminal to whatever voltage is applied to its second input terminal. The voltage depending on the output voltage may be applied to the second input terminal of the current conveyor 700. The current conveyor 700 may comprise a fourth circuit branch 400 and a fifth circuit branch 500. The fourth circuit branch 400 may comprise a seventh transistor 82 and a first current sink 86. The fifth circuit branch 500 may comprise an eighth transistor 84 and a second current sink 88. The first and second current sinks 86, 88 may be arranged closer towards the predetermined voltage level than the seventh and eighth transistors 82, 84. Control terminals (e.g. gate terminals) of the seventh and eighth transistors 82, 84 may be connected to each other, i.e. the seventh and eight transistors 82, 84 may form a current mirror. The control terminal of the seventh transistor 82 may be connected to a drain terminal of the seventh transistor 82. An output terminal of the current conveyor 700 may be provided at or connected to an intermediate node between the eighth transistor 84 and the second current sink 88. The output terminal of the current conveyor 700 may be connected to the control terminal of the sixth transistor 60.

Operation of the current conveyor 700 is analogous to that of the error amplifier 80 described above. For instance, assume that the output voltage V_out drops by some amount in the regulation mode, e.g. due to a change in the load that is applied to the output terminal 20. Then, the current conveyor 700, which acts as a Vds equalizer, will attempt to equalize voltages at the source terminals of the seventh and eighth transistors 82, 84. Thus, the eighth transistor 84 is biased such that the voltage at the source terminal of the eighth transistor 84 becomes equal to V_out. As a result, the voltage at the control terminal of the sixth transistor 60 increases, and likewise the voltage at the control terminal of the fourth transistor 70 increases. Accordingly, the fourth and sixth transistors 70, 60 are controlled to have a smaller resistance (i.e. to be more open). Since the fourth transistor 70 is more open, the current in the second circuit branch 200 may increase under control of the first feedback circuit, as described above (that is, the limiting current increases), and by operation of the first current mirror also the current flowing in the first circuit branch 100 increases, i.e. the output current I_out increases. Consequently, the output voltage V_out increases. For initially increasing output voltage V_out, the above-described changes of quantities would be reversed.

Figure 4:
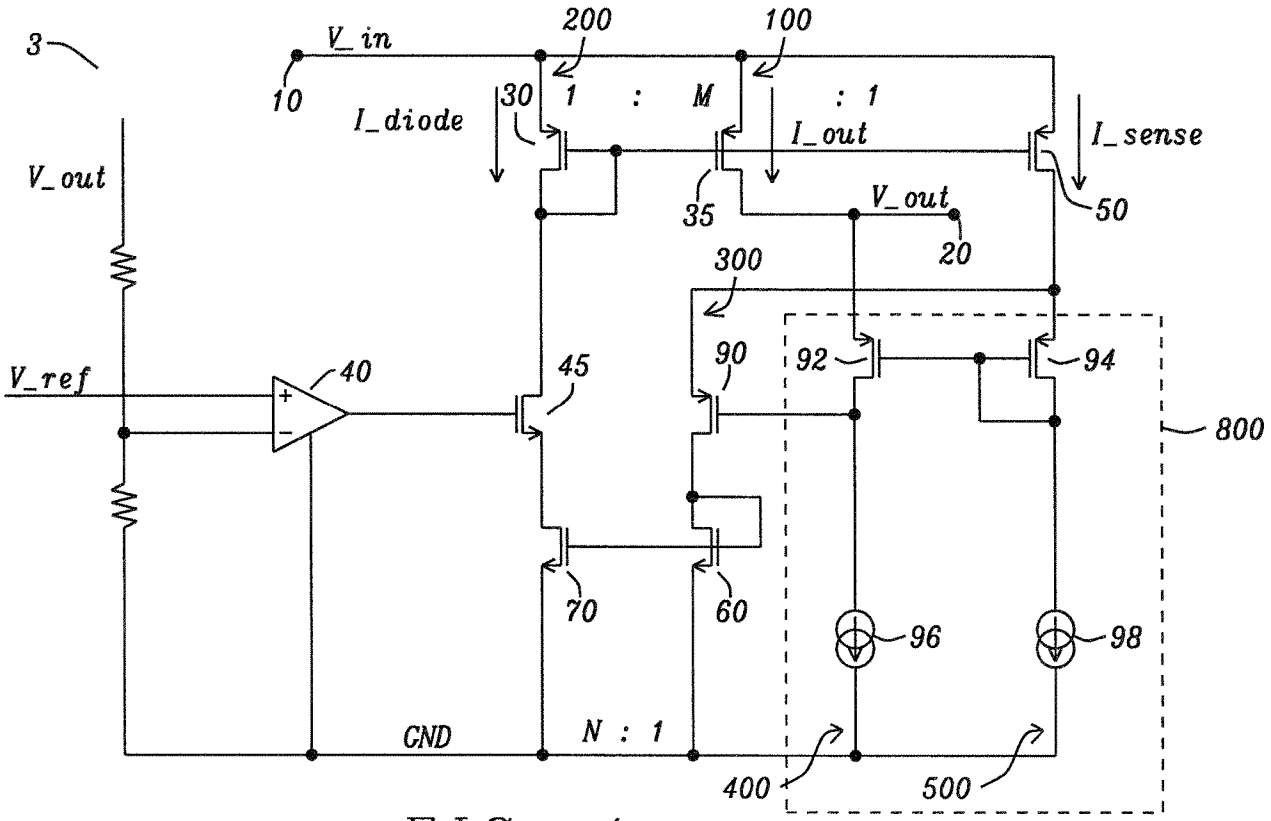

FIG. 4 schematically illustrates another exemplary implementation of the voltage regulator circuit 1 of FIG. 2. The voltage regulator circuit 3 (i.e. the second feedback circuit) may comprise, instead of the first error amplifier 80, a current conveyor (voltage mirror) 800. The current conveyor 800 may be a very fast current conveyor. The current conveyor 800 may receive the output voltage and the voltage at the output terminal of the current sensing means at its input terminals. The current conveyor 800 may be configured to equalize a voltage at its first input terminal to whatever voltage is applied to its second input terminal.

The voltage depending on the output voltage may be applied to the second input terminal of the current conveyor 800. The current conveyor 800 may comprise a fourth circuit branch 400 and a fifth circuit branch 500. The fourth circuit branch 400 may comprise a seventh transistor 92 and a first current sink 96. The fifth circuit branch 500 may comprise an eighth transistor 94 and a second current sink 98. The first and second current sinks 96, 98 may be arranged closer towards the predetermined voltage level than the seventh and eighth transistors 92, 94. Control terminals (e.g. gate terminals) of the seventh and eighth transistors 92, 94 may be connected to each other, i.e. the seventh and eight transistors 92, 94 may form a current mirror. Further, the control terminals of the seventh and eighth transistors 92, 94 may be connected to a drain terminal of the eighth transistor 94. An output terminal of the current conveyor 800 may be provided at or connected to an intermediate node between the seventh transistor 92 and the first current sink 96.

For the voltage regulator circuit 3 comprising the current conveyor 800, the third circuit branch 300 may comprise an additional ninth transistor 90 connected in series with the fifth transistor 50 and the sixth transistor 60. The ninth transistor 90 may be connected between the fifth transistor 50 and the sixth transistor 60. A control terminal of the ninth transistor 90 may be connected to the output terminal of the current conveyor 800, i.e. to the intermediate node between the seventh transistor 92 and the first current sink 96.

Operation of the current conveyor 800 proceeds similarly to that of the current conveyor 700 in FIG. 3 described above. For instance, assume that the output voltage V_out drops by some amount in the regulation mode, e.g. due to a change in the load that is applied to the output terminal 20. Then, the current conveyor 800, which acts as a Vds equalizer, will attempt to equalize voltages at the source terminals of the seventh and eighth transistors 92, 94. Thus, the eighth transistor 94 is biased such that the voltage at the source terminal of the eighth transistor 94 becomes equal to V_out. As a result, the voltage at the control terminal of the ninth transistor 90 decreases, and the ninth transistor 90 is controlled to have a smaller resistance (i.e. to be more open). Accordingly, the voltage at the control terminal of the sixth transistor 60 increases, and likewise the voltage at the control terminal of the fourth transistor 70 increases. Accordingly, also the fourth and sixth transistors 70, 60 are controlled to have a smaller resistance (i.e. to be more open). Since the fourth transistor 70 is more open, the current in the second circuit branch 200 may increase under control of the first feedback circuit, as described above (that is, the limiting current increases), and by operation of the first current mirror also the current flowing in the first circuit branch 100 increases, i.e. the output current I_out increases. Consequently, the output voltage V_out increases. For initially increasing output voltage V_out, the above-described changes of quantities would be reversed.

It is understood that each of the transistors described throughout the present disclosure may be a FET, in particular a MOSFET, such as a PMOS or an NMOS, for example. Particular examples in which each transistor is either a PMOS or an NMOS are illustrated in FIG. 2 to FIG. 4.

Further, while in the above reference is made to transistors, it is understood that the respective statements are likewise applicable to respective switching elements, output pass device and current sensing means that are exemplarily embodied by these transistors. For reasons of conciseness of the disclosure, respective statements relating to the switching elements, output pass device and current sensing means are not explicitly spelled out at every instance.

Figure 1:
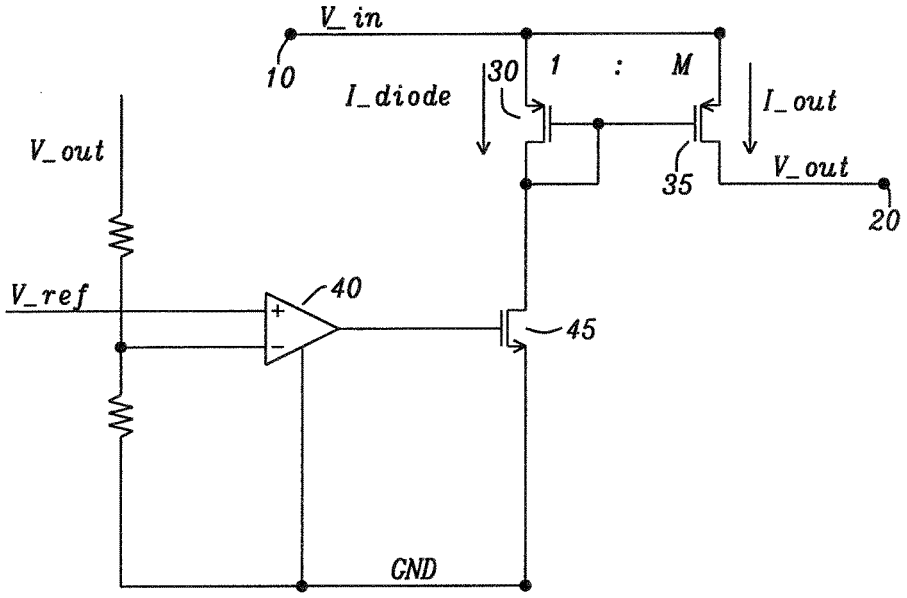
Figure 5:
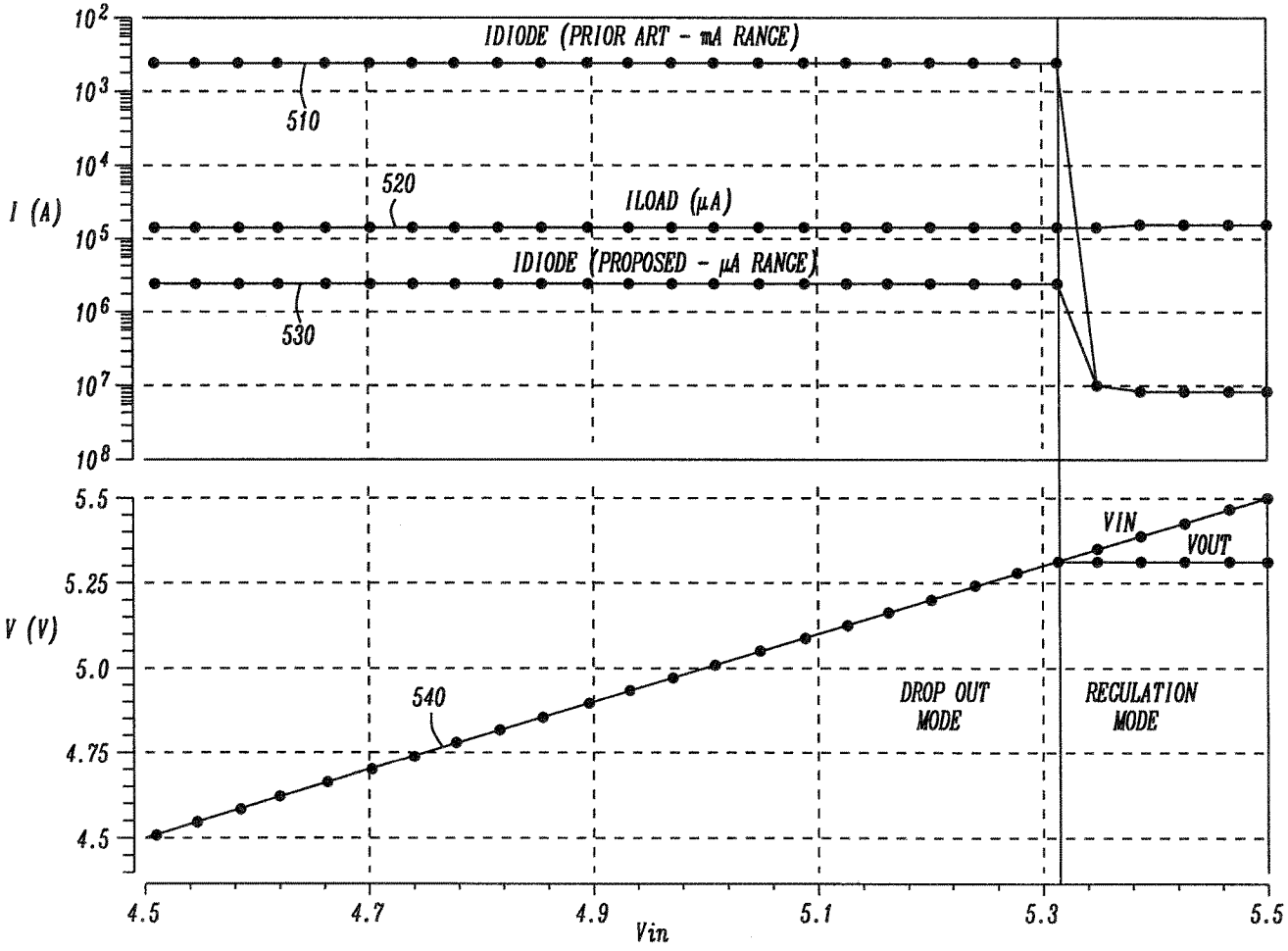
FIG. 5 is an exemplary diagram illustrating relevant voltages and currents in voltage regulator circuits according to embodiments of the disclosure.

FIG. 5 is an exemplary diagram illustrating relevant voltages and currents in voltage regulator circuits according to embodiments of the disclosure. The abscissa of the diagram is indicative of the input voltage V_in. The topmost graph 510 in the diagram indicates the current flowing in the second circuit branch in a conventional voltage regulator circuit as illustrated in FIG. 1. The second graph 520 from the top indicates the output current, or load current, I_out. The third graph 530 from the top indicates the current flowing in the second circuit branch in the voltage regulator circuit according to embodiments of the disclosure. Lastly, the bottommost graph 540 indicates the output voltage V_out.

For input voltages V_in below the threshold voltage (which slightly above 5.3 V in the example of FIG. 5), the voltage regulator circuit is in dropout mode and the output voltage V_out is substantially equal to the input voltage V_in (disregarding losses at pass devices and switching elements). As soon as input voltage rises above the threshold voltage, the first feedback circuit starts regulating the output voltage V_out (regulation mode), and the output voltage V_out becomes equal to a predetermined target value for the output voltage V_out. In dropout mode, current I_diode flowing through the second circuit branch in the voltage regulator circuit according to embodiments of the disclosure is somewhat below the output current I_out, whereas in the conventional voltage regulator circuit, the current I_diode is substantially larger than the output current I_out. Notably, the current I_diode in the conventional voltage regulator circuit is only limited by the on state resistance of the first switching element and a voltage drop across the second transistor 30 and may be excessive even for very small output currents (load currents) I_out.

The above difference between quiescent currents is a consequence of providing the second switching element under control of the second feedback circuit. A ratio between the output current I_out and the current I_diode flowing through the second circuit branch in embodiments of the disclosure is given by a function of the second and third mirror ratios described above, as the skilled person will appreciate, namely I_diode=N/M·I_out. Thus, in embodiments of the disclosure, the current I_diode flowing through the second circuit branch 200 may be limited to a value that is necessary for providing a desired output current I_out. Excessive quiescent currents are thereby effectively avoided, and overall power consumption of the voltage regulator circuit according to embodiments of the disclosure is reduced.

In the regulation mode, the current I_diode flowing through the second circuit branch is controlled to a value that is smaller than the output current I_out substantially by a factor M. The quiescent current in embodiments of the disclosure is by a factor N larger than the output current I_out. As explained above, choosing N larger than 1 guarantees for some margin for control of the first switching element in regulation mode and accounts for losses at pass devices and switching elements, and other imperfections. Otherwise, a case might occur in which the current I_diode flowing through the second circuit branch is limited to a value that is too small to still be able to produce a desired output current.

It should be noted that the apparatus features described above correspond to respective method features that may however not be explicitly described, for reasons of conciseness, and vice versa. The disclosure of the present document is considered to extend also to such method features and apparatus features, respectively.

It should further be noted that the description and drawings merely illustrate the principles of the proposed apparatus. Those skilled in the art will be able to implement various arrangements that, although not explicitly described or shown herein, embody the principles of the disclosure and are included within its spirit and scope. Furthermore, all examples and embodiment outlined in the present document are principally intended expressly to be only for explanatory purposes to help the reader in understanding the principles of the proposed apparatus. Furthermore, all statements herein providing principles, aspects, and embodiments of the disclosure, as well as specific examples thereof, are intended to encompass equivalents thereof.

What is claimed is:

1. A voltage regulator circuit for outputting a regulated output voltage, comprising an output terminal for outputting the output voltage;

a first circuit branch connected between an input voltage level and the output terminal;

a second circuit branch connected between the input voltage level and a predetermined voltage level, the second circuit branch comprising a first switching element and a second switching element connected in series;

a first current mirror for mirroring a current flowing in the second circuit branch to the first circuit branch;

a first feedback circuit for controlling the first switching element in dependence on the output voltage to thereby regulate the output voltage; and a second feedback circuit for controlling the second switching element, wherein the second feedback circuit comprises a current sensing means for sensing a current that depends on a current flowing in the first circuit branch; and the second feedback circuit is configured to control the second switching element such that the current flowing through the second circuit branch is limited to a current that is in a predetermined first ratio to the current sensed by the current sensing means, thereby limiting a quiescent current at low load currents, wherein the second switching element is a transistor that forms a current mirror with another transistor that is coupled in series with the current sensing means and that conducts the sensed current.

2. The voltage regulator circuit according to claim 1, wherein the first circuit branch comprises a first transistor connected between the input voltage level and the output terminal;

the second circuit branch comprises a second transistor, a third transistor, and a fourth transistor connected in series;

the first transistor and the second transistor form the first current mirror;

the third transistor acts as the first switching element;

the fourth transistor acts as the second switching element; and the current sensing means is configured to sense a current that depends on a current flowing through the first transistor.

3. The voltage regulator circuit according to claim 2, wherein the current sensing means is configured such that the current sensed by the current sensing means is in a predetermined second ratio to the current flowing through the first transistor.

4. The voltage regulator circuit according to claim 1, wherein the predetermined first ratio is larger than 1.

5. The voltage regulator circuit according to claim 2, wherein the second feedback circuit is configured to control the fourth transistor in dependence on the output voltage and a voltage at an output terminal of the current sensing means.

6. The voltage regulator circuit according to claim 2, wherein the second feedback circuit comprises a third circuit branch connected between the input voltage level and the predetermined voltage level, the third circuit branch comprises a fifth transistor and a sixth transistor connected in series;

the fifth transistor acts as the current sensing means;

the fifth transistor and the first transistor are configured to form a second current mirror;

the fourth transistor and the sixth transistor are configured to form a third current mirror; and the second feedback circuit is configured to control the sixth transistor in dependence on the output voltage and a voltage at an intermediate node between the fifth transistor and the sixth transistor.

7. The voltage regulator circuit according to claim 6, wherein the second feedback circuit is configured to output a drive voltage for driving the sixth transistor in dependence on the output voltage and the voltage at said intermediate node; and the second feedback circuit is configured to drive the sixth transistor such that the current flowing through the fourth transistor increases if the output voltage decreases, and to drive the sixth transistor such that the current flowing through the fourth transistor decreases if the output voltage increases.

8. The voltage regulator circuit according to claim 6, further comprising:

a current conveyor circuit receiving a voltage depending on the output voltage and a voltage depending on the voltage at said intermediate node at its input terminals, wherein an output terminal of the current conveyor circuit is connected to a control terminal of the sixth transistor.

9. The voltage regulator circuit according to claim 8, wherein the current conveyor circuit comprises:

a fourth circuit branch connected between the output terminal and the predetermined voltage level; and a fifth circuit branch connected between said intermediate node and the predetermined voltage level;

the fourth current branch comprises a seventh transistor and a first current sink connected in series;

the fifth current branch comprises an eighth transistor and a second current sink connected in series;

control terminals of the seventh and eighth transistors are connected to each other; and the output terminal of the current conveyor circuit is arranged between the eighth transistor and the second current sink.

10. The voltage regulator circuit according to claim 6, further comprising a current conveyor circuit receiving a voltage depending on the output voltage and a voltage depending on the voltage at said intermediate node at its input terminals, wherein the current conveyor circuit comprises:

a fourth circuit branch connected between the output terminal and the predetermined voltage level, the fourth circuit branch comprising a seventh transistor and a first current sink connected in series; and a fifth circuit branch connected between said intermediate node and the predetermined voltage level, the fifth circuit branch comprising an eighth transistor and a second current sink connected in series;

control terminals of the seventh and eighth transistors are connected to each other;

the voltage regulator circuit further comprises a ninth transistor arranged in the third circuit branch; and an output terminal of the current conveyor circuit is connected to a control terminal of the ninth transistor.

11. The voltage regulator circuit according to claim 1, further comprising a second error amplifier for controlling the third transistor, wherein the second error amplifier receives a reference voltage and a voltage depending on the output voltage at its positive and negative input terminals; and an output terminal of the second error amplifier is connected to a control terminal of the third transistor.

12. A method of operating a voltage regulator circuit for outputting a regulated output voltage, the voltage regulator circuit comprising:

an output terminal for outputting the output voltage;

a first circuit branch connected between an input voltage level and the output terminal; and a second circuit branch connected between the input voltage level and a predetermined voltage level, the second circuit branch comprising a first switching element and a second switching element connected in series, the method comprising:

mirroring a current flowing in the second circuit branch to the first circuit branch;

controlling the first switching element in dependence on the output voltage to thereby regulate the output voltage;

sensing a current that depends on a current flowing through the first circuit branch; and controlling the second switching element such that the current flowing through the second circuit branch is limited to a current that is in a predetermined first ratio to the sensed current, thereby limiting a quiescent current at low load currents, wherein the second switching element is a transistor that forms a current mirror with another transistor that is coupled in series with the current sensing means and that conducts the sensed current.

13. The method according to claim 12, wherein the first circuit branch comprises a first transistor connected between the input voltage level and the output terminal; and sensing said current is performed such that the sensed current depends on a current flowing through the first transistor.

14. The method according to claim 13, wherein the voltage regulator circuit comprises a second transistor that forms a current mirror with the first transistor and that acts as a current sensing means for sensing said current; and controlling the second switching element is performed in dependence on the output voltage and a voltage at an output terminal of the second transistor.

15. The method according to claim 14, wherein the voltage regulator circuit further comprises a third circuit branch connected between the input voltage level and the predetermined voltage level;

the third circuit branch comprises the second transistor and a third transistor connected in series; and the method further comprises:

mirroring a current flowing in the third circuit branch to the second circuit branch; and controlling the third transistor in dependence on the output voltage and a voltage at an intermediate node between the second transistor and the third transistor.

16. The method according to claim 15, further comprising:

generating a drive voltage for driving the third transistor in dependence on the output voltage and the voltage at said intermediate node, wherein generating the drive voltage is performed such that the current flowing through the second switching element increases if the output voltage decreases, and such that the current flowing through the second switching element decreases if the output voltage increases.

17. A method of providing a voltage regulator circuit for outputting a regulated output voltage, comprising the steps of:

outputting the output voltage at an output terminal;

connecting with a first circuit branch an input voltage level and the output terminal;

connecting with a second circuit branch the input voltage level and a predetermined voltage level, the second circuit branch comprising a first switching element and a second switching element connected in series;

mirroring with a first current mirror a current flowing in the second circuit branch to the first circuit branch;

controlling with a first feedback circuit the first switching element in dependence on the output voltage to thereby regulate the output voltage; and controlling with a second feedback circuit the second switching element, wherein the second feedback circuit comprises a current sensing means for sensing a current that depends on a current flowing in the first circuit branch; and the second feedback circuit controls the second switching element such that the current flowing through the second circuit branch is limited to a current that is in a predetermined first ratio to the current sensed by the current sensing means, thereby limiting a quiescent current at low load currents, wherein the second switching element is a transistor that forms a current mirror with another transistor that is coupled in series with the current sensing means and that conducts the sensed current.

18. The method according to claim 17, wherein the first circuit branch comprises a first transistor connected between the input voltage level and the output terminal;

the second circuit branch comprises a second transistor, a third transistor, and a fourth transistor connected in series;

the first transistor and the second transistor form the first current mirror;

the third transistor acts as the first switching element;

the fourth transistor acts as the second switching element; and the current sensing means senses a current that depends on a current flowing through the first transistor.

19. The method according to claim 18, wherein the current sensed by the current sensing means is in a predetermined second ratio to the current flowing through the first transistor.

20. The method according to claim 17, wherein the predetermined first ratio is larger than 1.

21. The method according to claim 18, wherein the second feedback circuit controls the fourth transistor in dependence on the output voltage and a voltage at an output terminal of the current sensing means.

22. The method according to claim 18, wherein the second feedback circuit comprises a third circuit branch connected between the input voltage level and the predetermined voltage level, the third circuit branch comprises a fifth transistor and a sixth transistor connected in series;

the fifth transistor acts as the current sensing means;

the fifth transistor and the first transistor form a second current mirror;

the fourth transistor and the sixth transistor form a third current mirror; and the second feedback circuit controls the sixth transistor in dependence on the output voltage and a voltage at an intermediate node between the fifth transistor and the sixth transistor.

23. The method according to claim 22, wherein the second feedback circuit outputs a drive voltage for driving the sixth transistor in dependence on the output voltage and the voltage at said intermediate node; and the second feedback circuit drives the sixth transistor such that the current flowing through the fourth transistor increases if the output voltage decreases, and to drive the sixth transistor such that the current flowing through the fourth transistor decreases if the output voltage increases.

24. The method according to claim 22, further comprising:

a current conveyor circuit receiving a voltage depending on the output voltage and a voltage depending on the voltage at said intermediate node at its input terminals, wherein an output terminal of the current conveyor circuit is connected to a control terminal of the sixth transistor.

25. The method according to claim 24, wherein the current conveyor circuit comprises:

a fourth circuit branch connected between the output terminal and the predetermined voltage level; and a fifth circuit branch connected between said intermediate node and the predetermined voltage level;

the fourth current branch comprises a seventh transistor and a first current sink connected in series;

the fifth current branch comprises an eighth transistor and a second current sink connected in series;

control terminals of the seventh and eighth transistors are connected to each other; and the output terminal of the current conveyor circuit is arranged between the eighth transistor and the second current sink.

26. The method according to claim 22, further comprising a current conveyor circuit receiving a voltage depending on the output voltage and a voltage depending on the voltage at said intermediate node at its input terminals, wherein the current conveyor circuit comprises:

a fourth circuit branch connected between the output terminal and the predetermined voltage level, the fourth circuit branch comprising a seventh transistor and a first current sink connected in series; and a fifth circuit branch connected between said intermediate node and the predetermined voltage level, the fifth circuit branch comprising an eighth transistor and a second current sink connected in series;

control terminals of the seventh and eighth transistors are connected to each other;

the voltage regulator circuit further comprises a ninth transistor arranged in the third circuit branch; and an output terminal of the current conveyor circuit is connected to a control terminal of the ninth transistor.

27. The method according to claim 17, further comprising a second error amplifier for controlling the third transistor, wherein the second error amplifier receives a reference voltage and a voltage depending on the output voltage at its positive and negative input terminals; and an output terminal of the second error amplifier is connected to a control terminal of the third transistor.

* * * * *